US008637752B2

(12) United States Patent
Innocenti

(10) Patent No.: US 8,637,752 B2
(45) Date of Patent: Jan. 28, 2014

(54) REMOVABLE STRAP MOUNTED INSTRUMENT STAND

(76) Inventor: Paul Innocenti, Phoenix, AZ (US)

( * ) Notice: Subject to any disclaimer, the term of this patent is extended or adjusted under 35 U.S.C. 154(b) by 235 days.

(21) Appl. No.: 13/060,266

(22) PCT Filed: Nov. 4, 2009

(86) PCT No.: PCT/US2009/063285

§ 371 (c)(1),
(2), (4) Date: Feb. 22, 2011

(87) PCT Pub. No.: WO2010/053995

PCT Pub. Date: May 14, 2010

(65) Prior Publication Data

US 2011/0198455 A1 Aug. 18, 2011

Related U.S. Application Data

(60) Provisional application No. 61/198,496, filed on Nov. 21, 2008.

(51) Int. Cl.
*G10D 1/02* (2006.01)

(52) U.S. Cl.
USPC ..... 84/280; 84/267; 84/327; 248/166; 248/168; 224/250

(58) Field of Classification Search
USPC ..... 84/327, 421, 453, 280, 267; 224/250; 248/166, 463, 465, 168, 169, 171, 170
See application file for complete search history.

(56) References Cited

U.S. PATENT DOCUMENTS

| | | | | |
|---|---|---|---|---|
| 4,037,815 | A * | 7/1977 | DeLano | 248/542 |
| 4,251,016 | A * | 2/1981 | O'Rafferty et al. | 224/250 |
| 5,197,701 | A * | 3/1993 | Olson | 248/166 |
| 6,422,522 | B1 | 7/2002 | Woollen | |
| 6,462,260 | B2 * | 10/2002 | Fediakov | 84/327 |
| 6,603,067 | B1 | 8/2003 | Woollen | |
| 7,464,216 | B2 * | 12/2008 | Gorobets | 711/103 |
| 7,541,536 | B2 * | 6/2009 | Daniel | 84/626 |
| 7,629,523 | B2 * | 12/2009 | Neagle | 84/329 |

OTHER PUBLICATIONS

International Search Report and Written Opinion dated May 31, 2010 for International Application No. PCT/US2009/063285.

* cited by examiner

*Primary Examiner* — Amy J Sterling
(74) *Attorney, Agent, or Firm* — Knobbe Martens Olson & Bear LLP

(57) ABSTRACT

A strap mounted instrument stand includes a pair of hingedly connected plates. The stand is movable between a closed position, in which the plates lie against one another in a generally flat configuration, and an open position, in which the plates are disposed at an angle with respect to one another. A bracket extends in a generally normal direction from one of the plates to support a musical instrument when the stand is in the open position. A securement member secures the plates together in the closed position. Releasing the securement member allows the stand to move to the open position. The stand holds a musical instrument, such as a guitar, in an upright position when not in use.

17 Claims, 18 Drawing Sheets

REMOVABLE STRAP MOUNTED INSTRUMENT STAND

CROSS-REFERENCE TO RELATED APPLICATIONS

This application claims priority to U.S. Provisional Application No. 61/198,496, filed Nov. 21, 2008, the disclosure of which is hereby incorporated herein by reference in its entirety.

BACKGROUND OF THE INVENTION

1. Field of the Invention

The present application relates to a strap mounted instrument support. More particularly, the present application relates to a removable, strap mounted instrument support configured to support a musical instrument, such as a guitar, in an upright position when not in use.

2. Description of the Related Art

Musical instruments can be expensive, and musicians are constantly faced with hazards, (both in the home and at performances), which can cause damage due to a lack of protection when the instrument is not in use. Instruments, therefore, require protection (when not inside a case) and a stand is the preferred manner of keeping an instrument available yet secure. In the case of a guitar, musicians habitually lean the headstocks against walls, or lay them on floors, which can invariably lead to damage from falling or being stepped upon. Traditional instrument stands are free standing, usually collapsible devices which represent an additional equipment item that a musician is required to carry and store.

There are different types of stands which are retained on instruments, however, they are invasive and awkward to the respective instrument in that they require the user to dismantle and reassemble sensitive elements of the instrument possibly compromising their integrity and/or damaging them, while also making it a semi-permanent fixture in that it would require the same disassembly to remove.

SUMMARY OF THE INVENTION

Embodiments of the invention relate generally to instrument supports and more specifically to a removable strap-mounted instrument stand for supporting a musical instrument, such as a guitar, in an upright position when not in use.

In accordance with one embodiment, an instrument stand for supporting a musical instrument is described. The stand comprises a first member, a second member which is movable relative to the first member such that in a first position the first member and the second member are in a collapsed configuration and in a second position the first and second member are configured in a manner that can support the musical instrument, and an instrument securing member adapted for securing the musical instrument to the instrument stand, wherein the instrument attachment member can be affixed to the first member or the second member so as to attach the instrument to the instrument stand when the first and second member are in both the first position and the second position. In one aspect of the embodiment, the first member and the second member are hingedly coupled. In another aspect, the stand further comprises a cross member configured to hold the first and second members in the second position. In another aspect, the instrument securing member comprises a strap coupled to the first member or the second member. In another aspect, the instrument stand further comprises a support member coupled to the first or second member. In another aspect, the first member and the second member are substantially flat when in the collapsed configuration. In another aspect, the instrument stand is configured to allow normal playing of the instrument when the instrument is attached to the instrument, at least when the first member and the second member are in the collapsed configuration. In another aspect, the instrument stand has a longitudinal axis and the longitudinal axis is substantially shorter in length than a longitudinal axis of the instrument.

In another embodiment, an instrument is attached to an instrument securing member on an instrument stand. The instrument stand comprises a first member, a second member which is movable relative to the first member such that in a first position the first member and the second member are in a collapsed configuration and in a second position the first and second member are configured in a manner that can support the musical instrument, and the instrument securing member. The instrument securing member is adapted for securing the musical instrument to the instrument stand. The instrument attachment member can be affixed to the first member or the second member so as to attach the instrument to the instrument stand when the first and second member are in both the first position and the second position.

In another embodiment, an instrument stand for supporting a musical instrument is described. The instrument stand comprises a first plate member, a second plate member pivotally coupled to the first plate member, an instrument securement member adapted to secure the instrument stand to the musical instrument, and a cross member coupled to the first or second plate member, the cross member lying in a generally flat configuration with respect to the first and second plate members at least when the stand is in the closed position, the cross member configured to maintain an angular separation of the first and second plate members at least when the stand is in the open position. In one aspect of the embodiment, the instrument securing member comprises a first flexible strap. In another aspect, the instrument securing member forms a loop. In another aspect, the instrument securing member has an adjustable length. In another aspect, the instrument securing member is coupled to the first or second plate member. In another aspect, the instrument securing member is removably coupled to the first or second plate member. In another aspect, the plate member to which the instrument securing member is coupled comprises a first pair of slots configured to receive the instrument securing member. In another aspect, the first pair of slots extend generally parallel to one another. In another aspect, the plate member to which the instrument securing member is coupled comprises a second pair of slots configured to receive the instrument securing member. In another aspect, the second pair of slots extend at an angle with respect to one another and with respect to the first pair of slots. In another aspect, the stand further comprises a support member coupled to the first or second plate member and configured to cooperate with the plate member to which it is coupled to support the musical instrument, at least when the stand is in an open position. In another aspect, the support member extends in a generally normal direction from the plate member to which it is coupled. In another aspect, the stand further comprises a securement member configured to releasably secure the first plate member and the second plate member together at least when the stand is in a closed position. In another aspect, the first plate member and the second plate member are secured in a generally flat configuration at least when the stand is in a closed position. In another aspect, the securement member comprises a hook and loop fastener. In another aspect, the securement member comprises a second flexible strap. In another aspect, the second flexible strap is coupled to the cross member. In another aspect, the cross member is coupled to the first plate member. In another aspect, the second plate member comprises a groove for slidably receiving an end of the cross member at least when the stand is moved between the closed position and the open position. In another aspect, the musical instrument is selected from the group consisting of a guitar, a bass guitar, an acoustic guitar, a lute, a sitar, a mandolin, a banjo, a ukulele, a violin, a viola, a cello, an upright bass, a guitar shaped video-game controller, a keyboard, and a synthesizer.

In still another embodiment, a musical instrument has an instrument stand attached thereto. The instrument stand comprises a first member, a second member which is movable relative to the first member such that in a first position the first member and the second member are in a collapsed configuration and in a second position the first and second member are configured in a manner that can support the musical instrument, and an instrument securing member adapted for securing the musical instrument to the instrument stand, wherein the instrument attachment member can be affixed to the first member or the second member so as to attach the instrument to the instrument stand when the first and second member are in both the first position and the second position.

There has thus been outlined, rather broadly, some of the features of certain embodiments in order that the detailed description thereof may be better understood, and in order that the present contribution to the art may be better appreciated. There are additional features of the invention that will be described hereinafter. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The various embodiments of the present invention may be constructed using materials and components that are commercially available or may, for example, be fabricated based on the disclosure herein.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
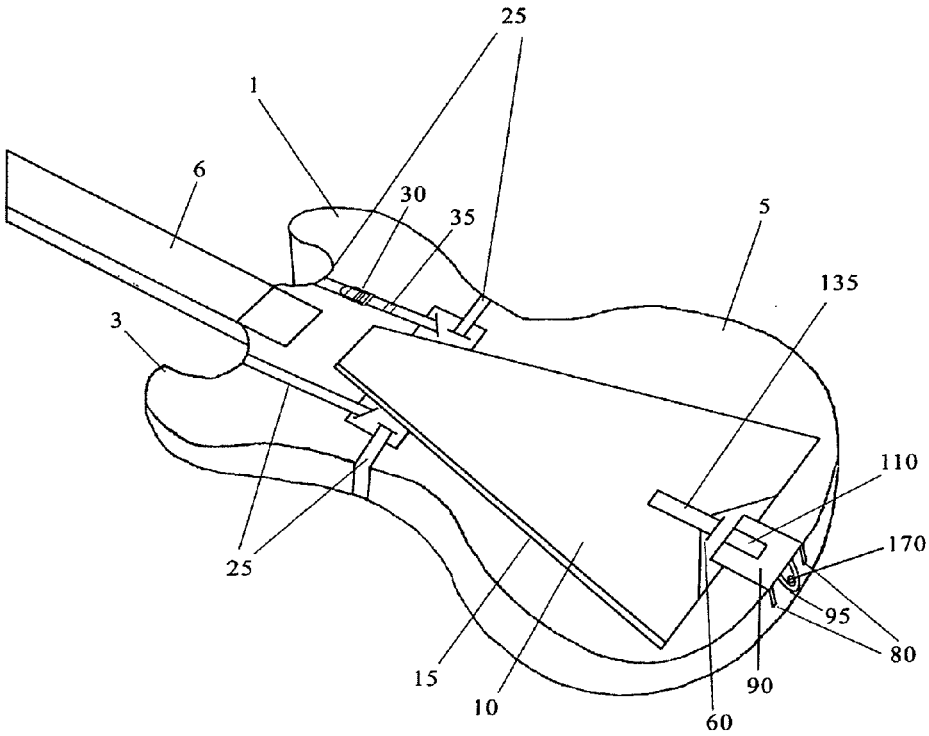
FIG. 1 is a perspective drawing of an instrument stand according to an embodiment, shown in a closed position and mounted on the rear of an exemplary guitar that having an upper and lower cutaway.

All references cited herein are expressly incorporated by reference in their entirety unless otherwise specifically stated.

One device, U.S. Pat. No. 6,603,067 by Woolen is overly cumbersome and complex in design and function. One problem is that it requires the user to unscrew the wood screw, which retains the lower guitar strap endpin, and then mount the stand in between the guitar and the endpin. Musicians tend to be apprehensive about dis-assembling their instruments for fear that they may incur damage, and therefore, a technician would preferably be hired to attach the stand, costing additional money and putting the configuration in a state of semi-permanence.

Another very common problem and complaint for guitar players is when the threads of the wood screw which retains the lower guitar strap endpin, (not so much with the upper strap endpin), strips out the wood of the guitar due it being put under constant stress from bearing the weight of the guitar while being worn, or subjected to other forces such as the weight of a guitar repeatedly being placed onto this particular stand which utilizes this endpin as one of its' main weight distribution components. Wood screws tend not to be as tight when re-tightened back into the wooden body (due to the already compressed wood fibers), and therefore, require either a larger screw (not possible with standard endpins), or filling the previous hole with some kind of wood filler. After constant use and stress, this design will cause the endpin to loosen and/or strip, thus compromising the integrity of this design and causing potential damage to the instrument.

Yet another issue with this design is the rigid plastic material being pressed against the user's body and the guitar while in the collapsed position. Constant movement of the player and the guitar while strapped on will almost certainly cause abrasion to the user and the instrument, and in the case of rough usage may cause undo stress on the endpin mount and possible breakage to the plastic itself. Some guitar finishes are extremely sensitive and expensive, and there is nothing keeping the hard plastic from coming in contact with its surface. This design is also not streamlined enough to prevent it from possibly catching on things such as belt buckles.

Another device U.S. Pat. No. 5,197,701 by Olson, is unsuitable for attaching to different types of guitars, awkward to use, mechanically complicated, and obtrusive to the player. The use of suction cups to attach the stand presents some challenges. While the backs of guitars are usually smooth finished wooden surfaces, they may not always be flat enough to accommodate suction cups as in the case of some hollow body guitars. Suction cups may be considered invasive in the respect that once adhered, they may require some kind of outside force to peel them apart from the guitar surface, which could potentially scratch or mar the surface. Suction cups can also suddenly lose their adhesion integrity if the vacuum is compromised (as often happens with suction cups) thus causing the guitar to fall off of the stand.

Also, the Olson device automatically deploys with spring-loaded legs when the guitar is placed against the ground, and could accidentally deploy if the rear of the instrument is pressed against anything other than the ground.

In addition to the aforementioned, the Olson design is considerably complex, and would require a considerable number of steps in the manufacturing process. The use of many small, custom made parts makes for a higher potential for mechanical failure and the need for many additional manufacturing steps.

Lastly, the Olson design would be obtrusive to the player, as it seems to protrude at an uncomfortable thickness, and nothing is shown to protect the player from the end of the legs, or protect the guitar body finish from lateral motion and excessive forward depression.

The features, aspects and advantages of the present invention will now be described with reference to the drawings of several embodiments, which are intended to be within the scope of the invention herein disclosed. These and other embodiments will become readily apparent to those skilled in the art from the following detailed description of the embodiments having reference to the attached figures, the invention not being limited to any particular embodiment(s) disclosed.

Some embodiments of the present invention a) provide a stand for a musical instrument that can be easily mounted to the instrument, requiring no special tools to remove or attach it; b) provide a stand for a musical instrument that can be universally adapted and attached to a variety of different instruments; c) provide a stand for a musical instrument that folds up flat against the instrument making it barely detectable by the user while playing the instrument; d) provide a stand for a musical instrument that will limit the risk of abrading the instrument's finish, or interfering with any of its components; e) provide a stand for a musical instrument that actually protects the instrument finish against abrasion; f) provides a stand for a musical instrument that is extremely simple in design and function, and with a limited number of moving parts; g) provide a stand for a musical instrument that is easy to manufacture and maintain, and can be offered to the public at a relatively low cost; h) provide a stand for a musical instrument that eliminates the need to carry a separate stand; and/or i) provide a stand for a musical instrument that is incredibly stable, very lightweight, low profile, and easy to transport. Advantages of such embodiments include versatility (the ability to use it on a variety of different instruments), a low profile (comfort and non-hindrance of the user), the ability to add or remove it at any time and without special tools, and real functional stability.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application by one skilled in the art to which it pertains.

In some embodiments, an instrument stand is configured to be temporarily (that is, removably) attached to an instrument using no tools or invasive means, and is configured to be easily manually deployed. The stand is also preferably configured to be very stable, at least when it is in an open (deployed) position. In some embodiments, the stand may be comprised of two separate plates that are hinged together, for example at a top region of the plates. The plates are preferably comprised of a rigid material. In some embodiments, the plates can comprise PVC, ABS, plexiglass, Lexan, Fiberglass, or a combination of one or more of these materials. Alternatively, in some embodiments, metal, such as steel, aluminum, brass, or alloys could be used for the plates. In other embodiments, plastic and/or metal rods or pipes creating a similar framework can be used to form the plates. The plates can comprise any other material suitable for their intended purpose.

In some embodiments, one or more straps (comprising any suitable material such as flexible fabric, cord or cloth), can be connected to one or both of the plates, for example by weaving the strap or straps through one or more slots, openings, or other guides in the plate. In some such embodiments, the stand can be configured to be mounted to the back of an instrument in any suitable fashion, for example by looping the straps around the instrument's contours or cutaways (if present), around the instrument's top strap pin (if present), and/or around the body of the instrument. The stand can be configured to be removably secured to the instrument in any other suitable fashion. In some embodiments, the strap or straps can be tightened to secure one or both plates against the back of the instrument, for example by using a compression buckle. Any other means of tightening and/or securing the strap can be employed, including without limitation one or more knots, pulleys, hook and loop fasteners, buckles, and/or any kind of retainer suitable for tightening and/or securing the strap (or straps) in place.

In some embodiments, one of the plates can include one or more supports extending at an angle from the plate. The supports preferably extend from the plate at a generally normal angle, although other angles are also possible. By such a configuration, the supports can extend underneath a bottom portion of the instrument as the plate extends behind the back of the instrument, at least when the instrument is in an upright position and the stand is in an open position. The supports can be configured to cooperate with the plate to support the instrument, at least when the instrument is in an upright position and the stand is in an open position. The supports preferably comprise steel, but can comprise any other suitably rigid material, including plastic. In some embodiments, the plate including the supports can be additionally secured to the instrument near the region of the supports. For example, a lower portion of the plate can be secured to a pin at the bottom of the instrument (if present) using a flexible or adjustable strap or loop. In some embodiments, the securement straps can be configured to be secured in place on the instrument (or on the stand) under tension.

In some embodiments, the stand can be configured to be opened from its collapsed state by pulling on a flexible strap or cord, which can be woven through a slot or guide in one of the plates. In some embodiments, the strap can be affixed to the top of a movable cross member which is hinged at one end to one of the plates, such that pulling on strap causes the cross member to move from a generally parallel position with respect to the plates, to a position in which it extends in a generally normal direction to separate the plates. In some embodiments, in the parallel (or closed) position, the cross member can lie stored within a cavity in one of the plates. In some embodiments, the cross member can include a pin which travels along slots provided in one of the plates as the cross member moves between a closed position and an open position. In some embodiments, the same pull strap can be configured to releasably secure the stand in a closed position and to releasably secure the cross member in the open position. For example, the strap can be configured to wrap around an edge of the opposite plate and be coupled to that plate, preferably using Velcro. In some embodiments, the strap can be secured using other means such as buckles or knots. In some embodiments, one of the plates includes a groove or cavity configured to house cross member. The top and bottom plates may be covered with a soft material such as nylon, cloth, felt, or leather to protect the instrument finish and the user while being used.

Therefore, some embodiments provide a stand for supporting an instrument in an upright position. In some embodiments, the stand can be mounted using no tools. In some embodiments, the stand can rest (in a closed position) against the back of the instrument without interfering with the player's ability to hold or play the instrument. In some embodiments, the stand is configured to be deployed to the open position with only a single hand, such that the stand can be deployed with one hand while the player holds the instrument with the other hand. The stand is preferably lightweight, affordable, and configured to provide excellent stability when deployed.

Figure 2:
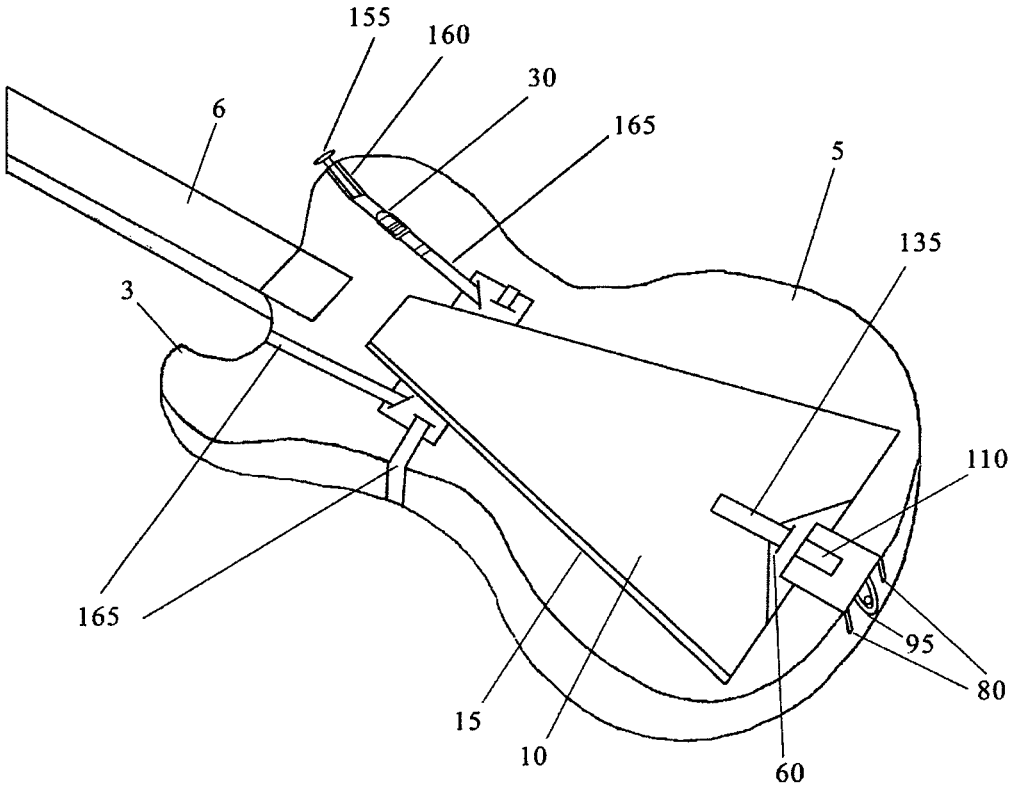
FIG. 2 is a perspective drawing of the instrument stand of FIG. 1, shown in a closed position and mounted on the rear of another exemplary guitar having a lower cutaway and an upper strap pin.

In a preferred embodiment of the present invention illustrated in FIG. 1 a support stand 8 is shown in its closed position mounted on a guitar 5. The stand 8 comprises a lower plate 15 which has a strap 25 woven around guitar 5 cutaways 1 and 3. The strap 25 is secured under tension with buckle 30, which is attached to one end of strap 25. The other end of the strap 25 is then secured by weaving it through buckle 30 and pulling it tightly. Any excess strapping material can be retained using a strap keeper 35. In the illustrated closed position, a top plate 10 rests flush against bottom plate 15. The top plate 10 is kept secured in this position by a pull strap 135, which is affixed via a hook-and-loop fastener to the top plate 10. The base of guitar 5 rests upon two angled instrument rests 80. A retaining strap 95 is looped around the guitar's lower strap pin 170, woven under tensioner plate 90, and affixed in a tensioned position with a hook-and-loop fastener 110. The stand 8 is shown in FIG. 2 with an alternative strap 165 including a buckle 30. The strap 165 is configured for use with an instrument having an upper endpin 155. The strap 165 includes a loop 160 which is adapted to loop around the upper endpin 155 and thereby cooperate to secure the stand 8 on the guitar.

Figure 3:
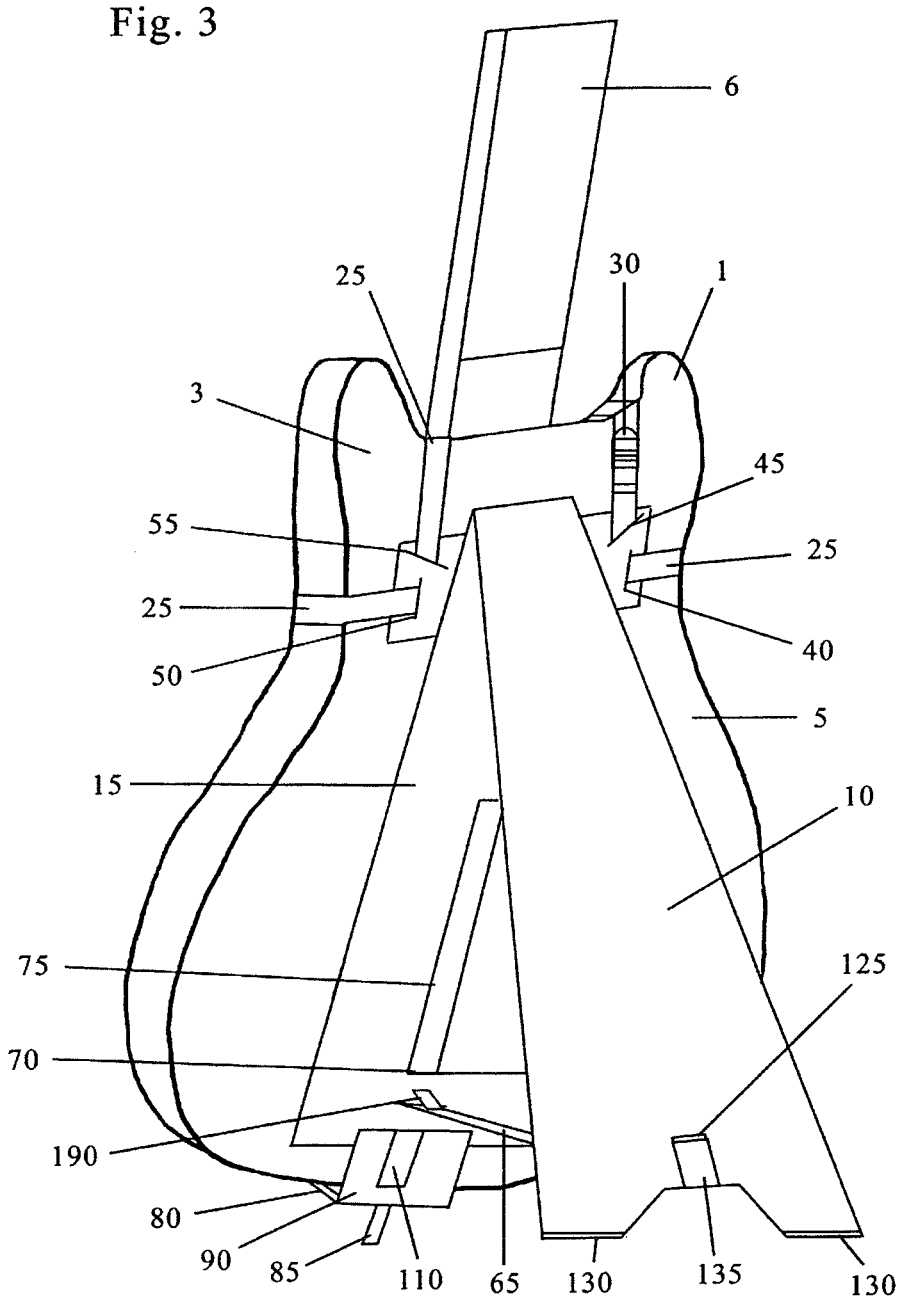
FIG. 3 is a perspective drawing of the instrument stand of FIG. 1, shown supporting the guitar of FIG. 1 in an open and upright standing position.
Figure 4:
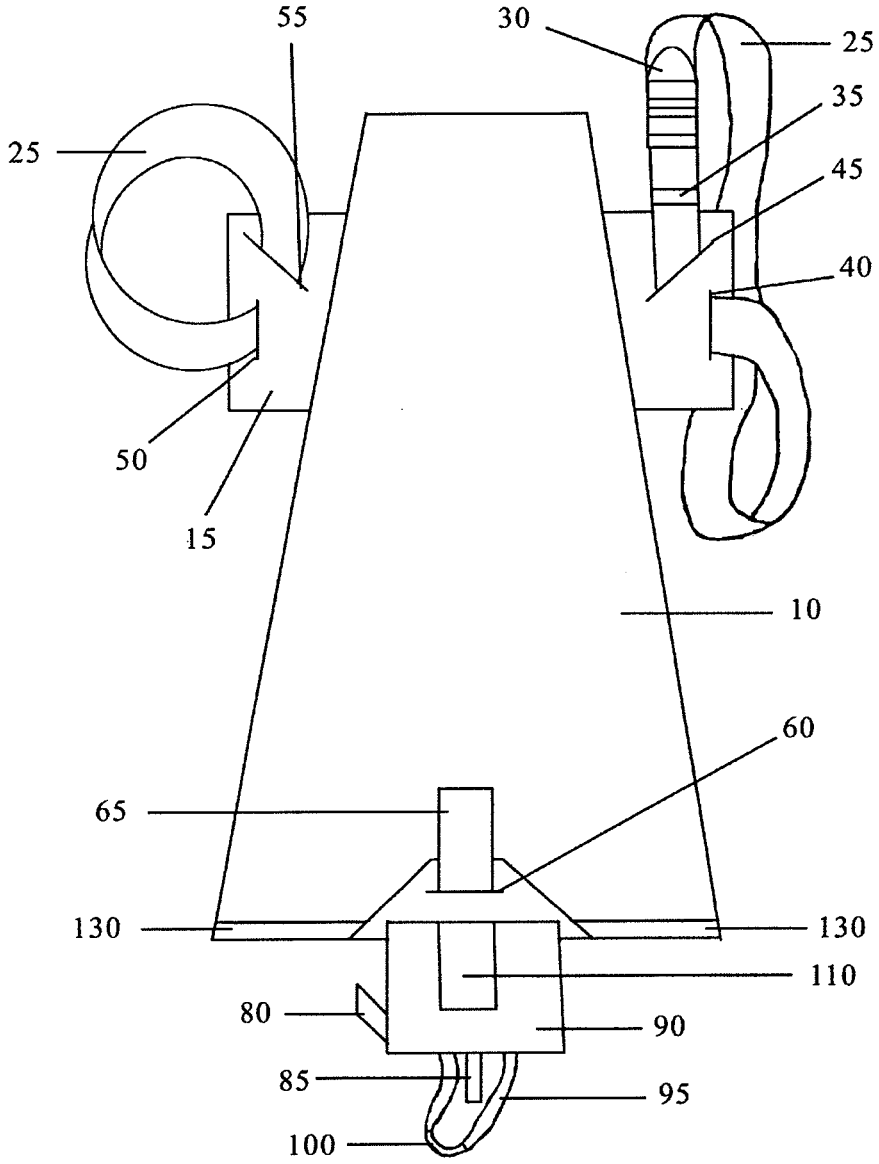
FIG. 4 is a perspective drawing illustrating the top surface of the instrument stand of FIG. 1, which is shown un-mounted and in a closed position.
Figure 5:
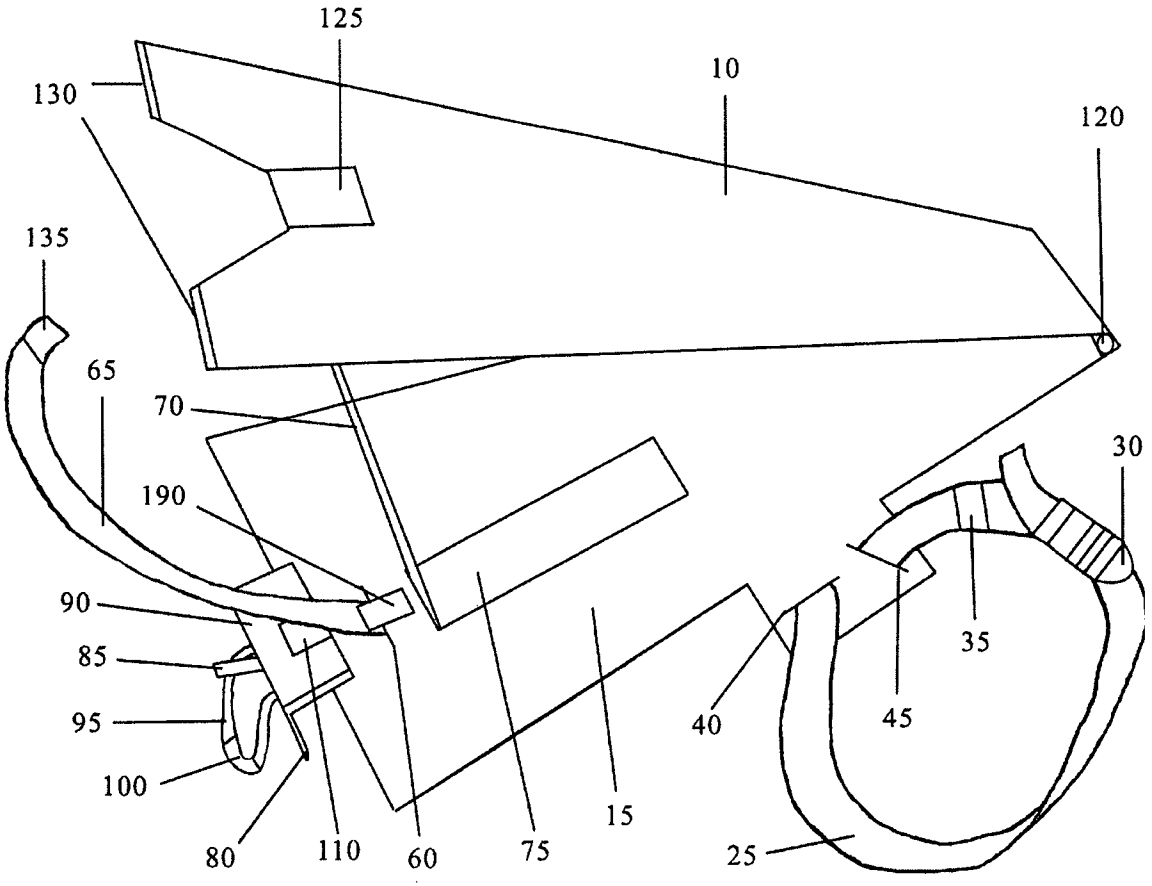
FIG. 5 is a perspective drawing of the instrument stand of FIG. 1 in an un-mounted and open position.

FIG. 3 shows the stand 8 in its open position, while still mounted to the back of guitar 5. Strap 25 is woven through four slots 40, 45, 50, and 55 in the bottom plate 15. When a cross-member pull strap 65 is pulled in a direction away from the back of the guitar 5, a cross-member 70 moves from a stored position (within a groove 75 in the bottom plate 15) to an open position in which the cross-member 70 extends between the top and bottom plates 10, 15 and holds them apart. As the cross-member 70 moves into the open position, it pivots with respect to the top plate 10, and one end of the cross member 70 travels from a top end of the groove 75 to a bottom end of the groove 75. The cross member 70 helps to move the top plate 10 outward as it pivots with respect to the bottom plate 15 at top hinge 120 (not shown in FIG. 3). In the open position illustrated in FIG. 3, the cross member 70 is secured under tension to top plate 10 with hook-and-loop fasteners 125, 135. The guitar 5 can then be stood upright and be supported by at least three points of contact: two non-slip footings 130 and a bottom plate support pin 85. FIG. 4 shows a back view of the stand in a closed position, apart from an instrument. FIG. 4 illustrates the open loops of the strap 25. FIG. 5 shows the stand in an open position, apart from an instrument, but with the pull strap 65 unsecured.

Figure 6:
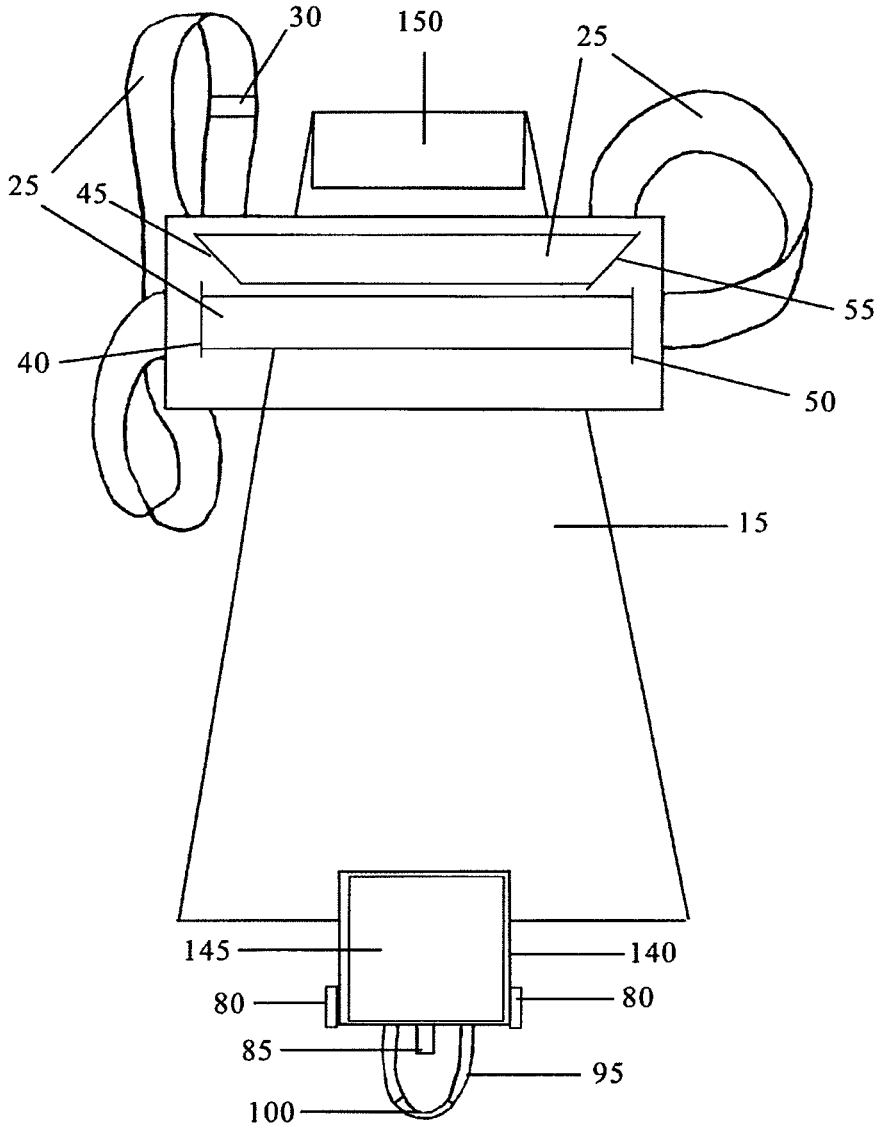
FIG. 6 is a perspective drawing illustrating the bottom surface of the instrument stand of FIG. 1, which is shown un-mounted and in a closed position.

FIG. 6 shows a front view of the stand (unmounted to an instrument), and illustrates how the strap 25 weaves through the slots. An upper non-slip pad 150 and a lower non-slip pad 145 allow the stand to rest against the back of guitar 5 to minimize movement and damage to the instrument finish.

Figure 7:
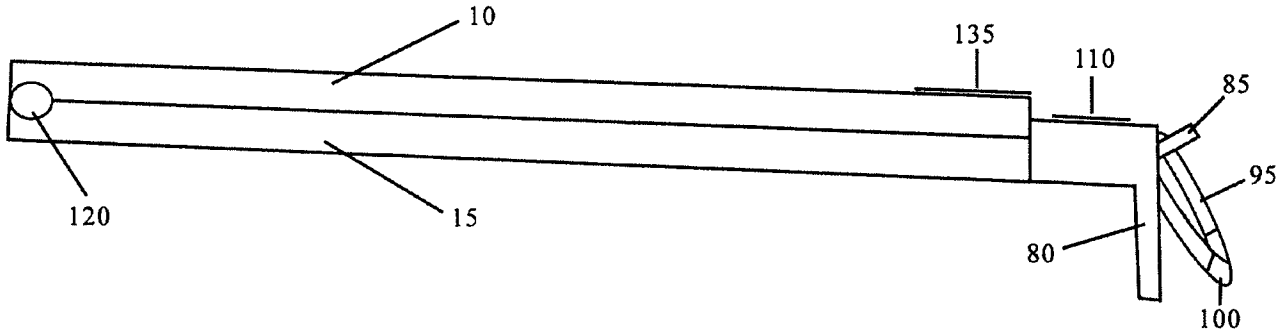
FIG. 7 is a side view of the instrument stand of FIG. 1, shown in a closed position.

FIG. 7 shows a side view of the stand 8 in a closed configuration. Although the illustrated embodiment has a planar configuration, other embodiments can be configured with a slight curvature if desired, for example to adapt to the curvature of a particular instrument.

Figure 8:
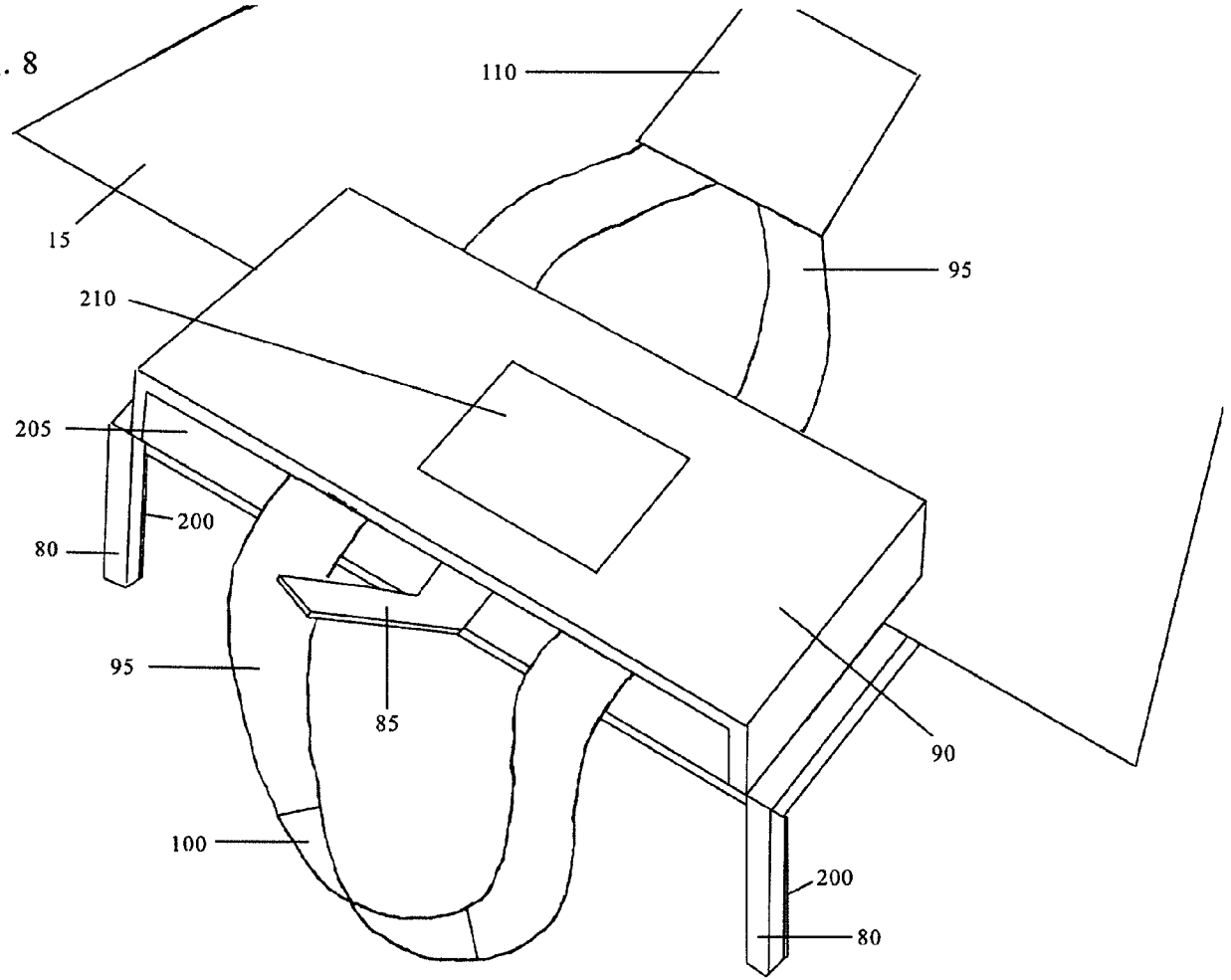
FIG. 8 is a close-up perspective drawing illustrating the lower strap pin retaining assembly of the instrument stand of FIG. 1.

FIG. 8 is a close-up view of the lower endpin-retaining assembly where a slot 205 is created when a gap exists by attaching a tensioning plate 90 to the bottom plate 15. As the base of guitar 5 rests upon non-slip pads 200 affixed to angled instrument rests 80 which are affixed to bottom plate 15, the endpin retaining strap 95 is looped around a lower guitar endpin 170. The strap 95 is then woven through the slot 205 and attached to a tensioner 110. The tensioner 110 is then pulled and affixed under tension to the plate 15 using a hook-and-loop fastener 210, thus securing the bottom of guitar 5 to the stand.

Figure 9:
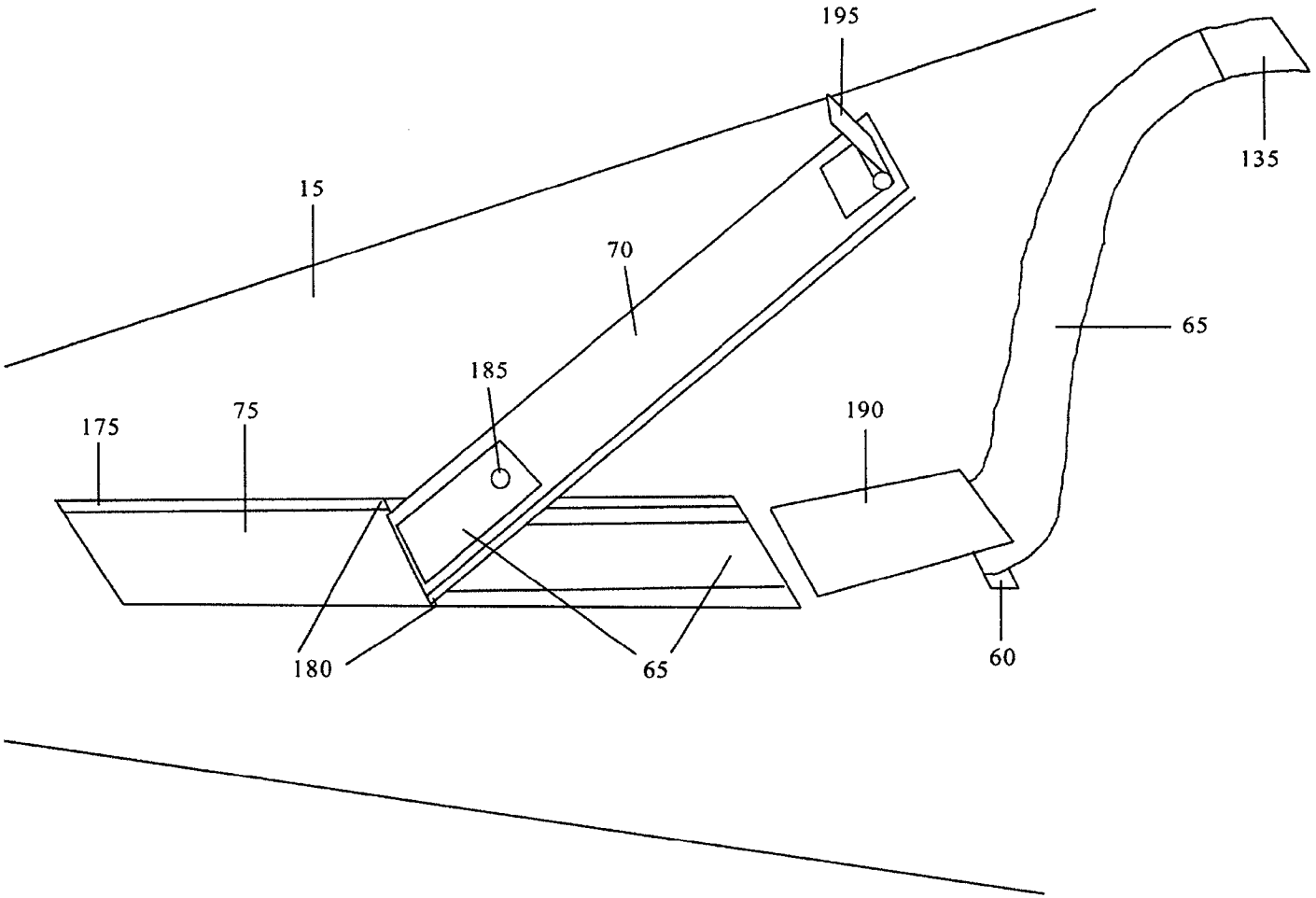
FIG. 9 is a close-up perspective drawing illustrating the cross member slot assembly of the instrument stand of FIG. 1.

FIG. 9 shows a close-up view of the cross-member assembly, with the top plate 10 removed to provide a better illustration. A pin 180 is attached to cross-member 70 and travels along slots 175 disposed at the sides of the groove 75 when the pull strap 65 (attached to cross-member 70 with retainer 185) is pulled, or when cross-member 70 is pushed back into the closed position in the groove 75. A hinge 195 is affixed to the bottom of top plate 10, and allows the top plate 10 to be pushed in or pulled out by the movement of the cross-member 70. A pull strap keeper 190 is a semi flexible piece of material comprised of rubber, or plastic, or flexible metal, whose base is partially affixed to the bottom plate 15 and slightly rests upon the strap 65 keeping the strap 65 in line with the slot 60 when the cross-member 70 is pushed back into its closed position.

Figure 10:
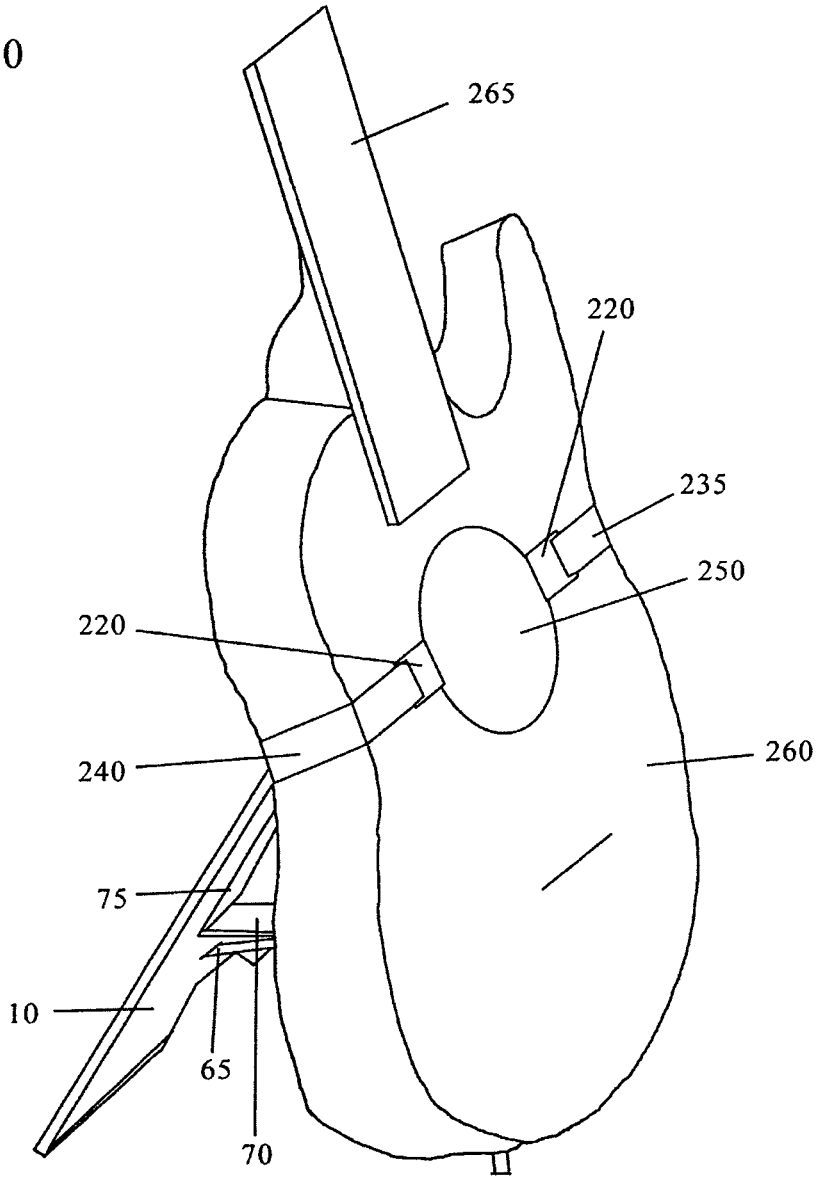
FIG. 10 is a perspective drawing of the instrument stand of FIG. 1, shown with an acoustic guitar with the acoustic guitar mounting strap assembly and shown mounted on the back of an exemplary acoustic guitar.
Figure 12:
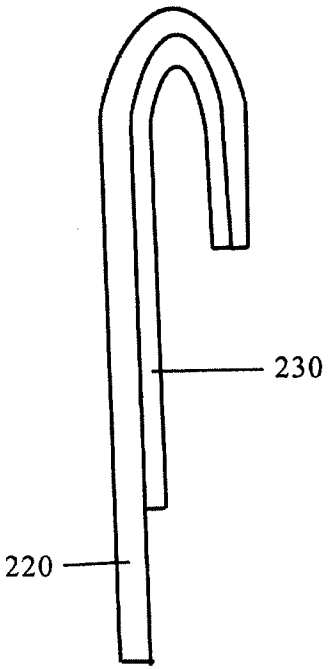
FIG. 12 is a side view of the sound hole hook assembly shown in FIG. 11.
Figure 11:
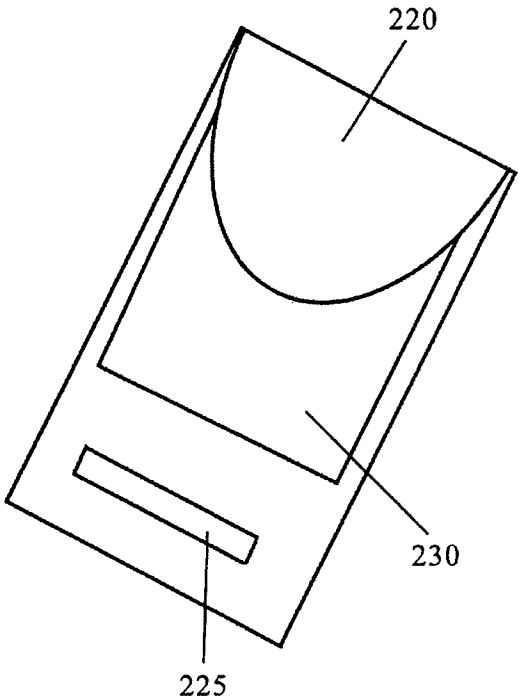
FIG. 11 is a close-up perspective drawing of the sound hole hook assembly of the embodiment illustrated in FIG. 10.
Figure 13:
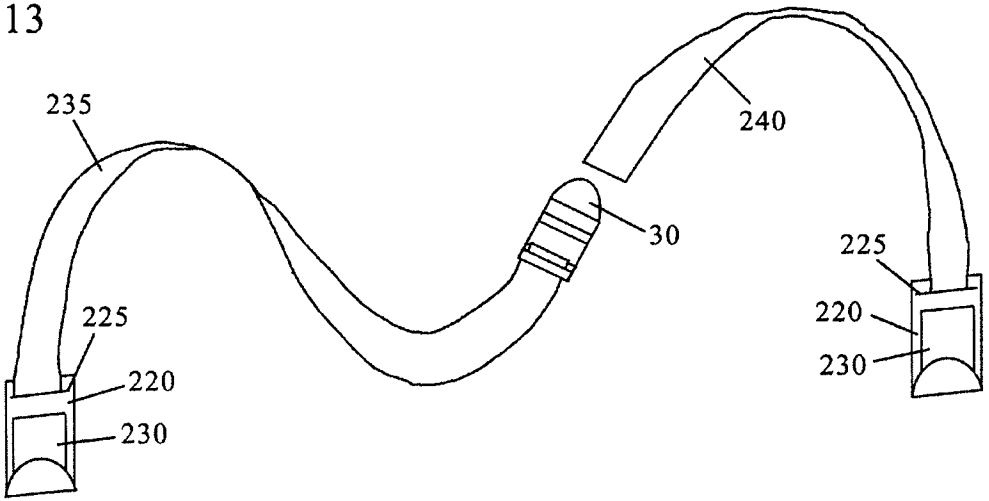
FIG. 13 is a perspective drawing of the acoustic guitar instrument mounting strap assembly illustrated in FIG. 10, shown apart from the rest of the instrument stand.
Figure 14:
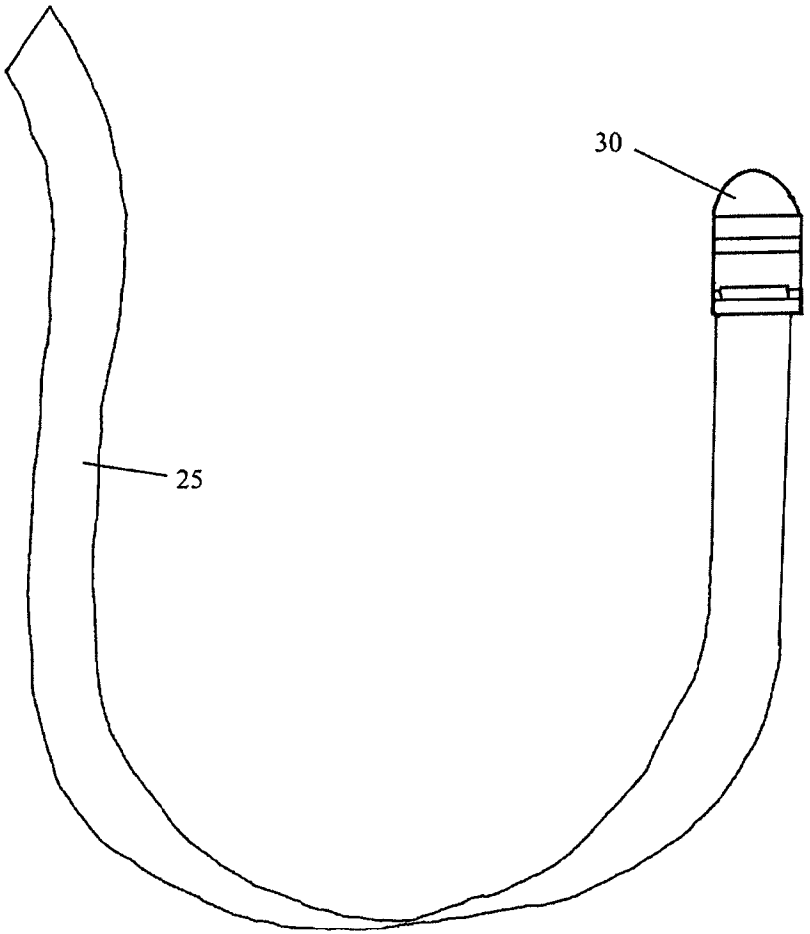
FIG. 14 is a perspective drawing of a universal strap assembly.
Figure 15:
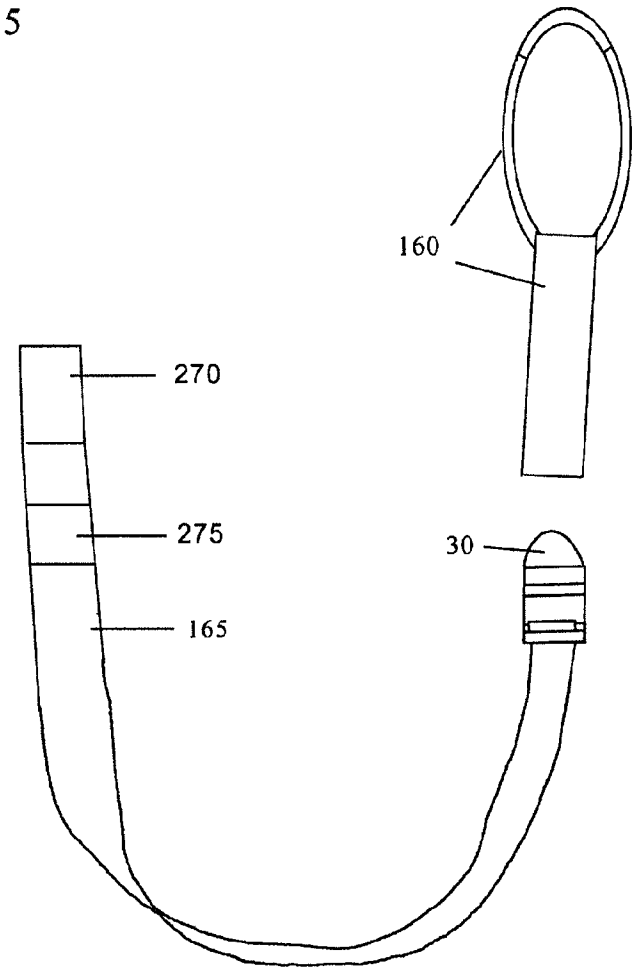
FIG. 15 is a perspective drawing of the upper strap pin strap assembly and mounting strap illustrated in FIG. 1.
Figure 16:
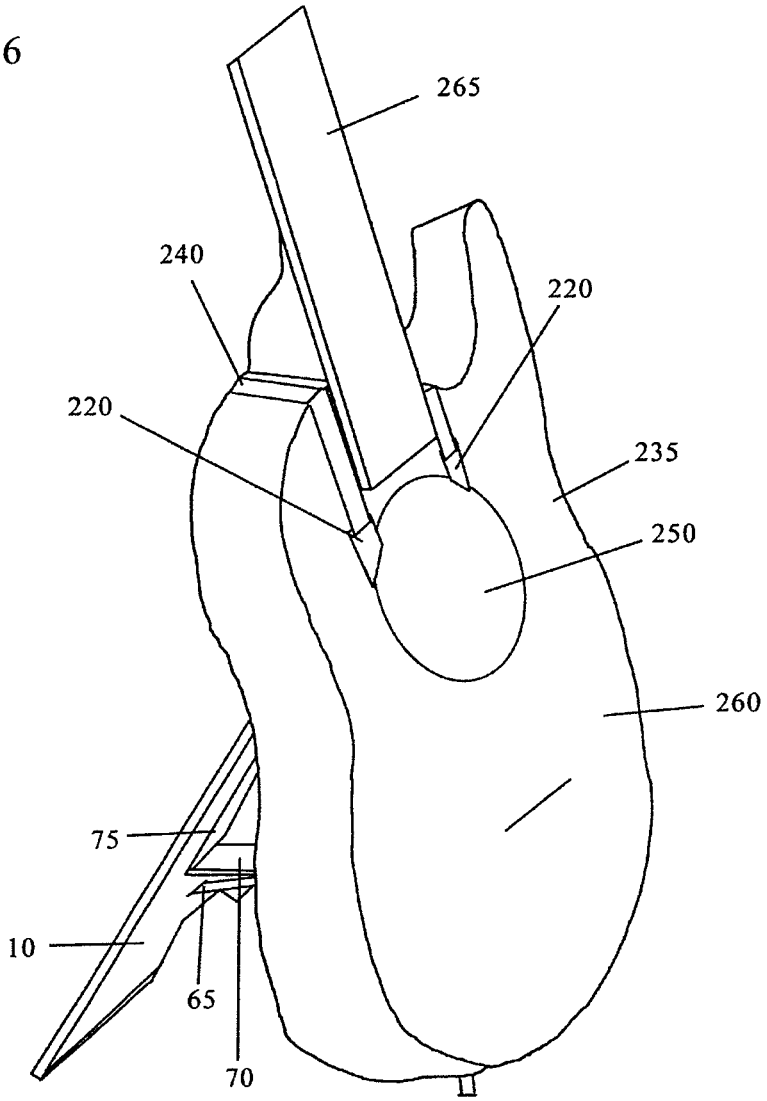
FIG. 16 is a perspective drawing of an instrument stand according to another embodiment, shown in an open position and mounted to another exemplary acoustic guitar, with the strap assembly hooked onto the sound hole near the neck of the guitar.
Figure 17:
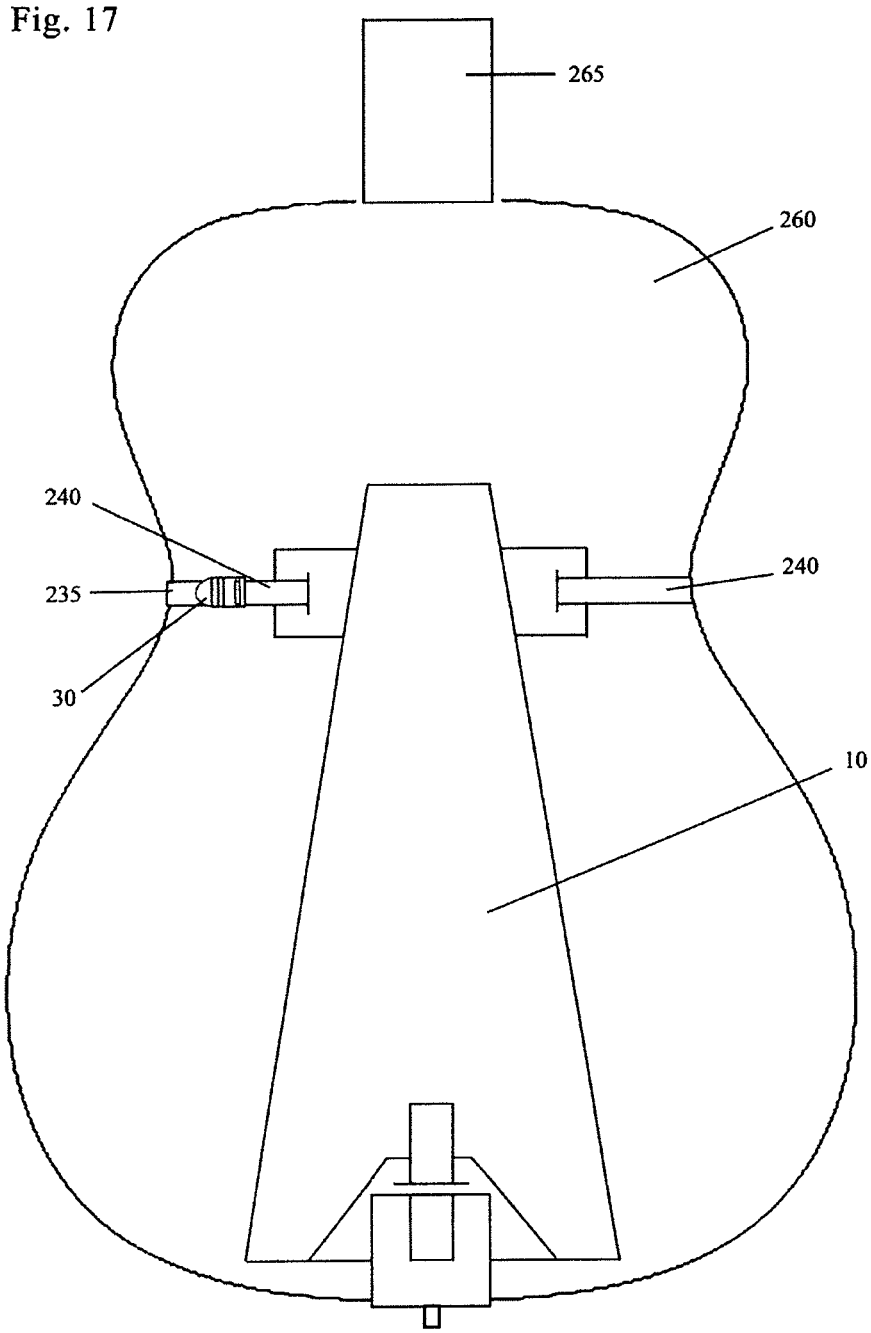
FIG. 17 is a plan view of an instrument stand according to an embodiment, shown in a closed position and mounted to the back of a guitar, with the strap assembly wrapping around the sides of the guitar to grip the sound hole.

In embodiments adapted for an acoustic guitar, the stand can be mounted in generally the same manner as previously described, and the entire stand can function generally in the same manner as previously described, but with a different strap configuration which is particularly adapted for an acoustic guitar. In some embodiments, a number of alternative strap assemblies can be provided, each assembly being adapted for a different instrument. With such an embodiment, a user can select the appropriate strap for a particular instrument, and switch the strap out when he or she decides to change instruments. As an example, FIG. 10 shows the same stand 8 provided with alternative straps 235, 240 which are adapted for use on an acoustic guitar 260. The straps 235, 240 include hooks 220 configured to hook onto the top and bottom of the sound hole 250. The straps 235, 240 are then wrapped around the body of the guitar, and are coupled together by a buckle 30 and pulled under tension. FIG. 17 shows the back of an acoustic guitar 260, and illustrates how the bottom plate 15 can be modified in another embodiment to have only two slots (instead of four) to accommodate a single continuous strap 240. FIG. 16 shows the strap hooks 220 hooked onto the sound hole 250 in an alternative fashion. FIG. 13 shows the strap assembly apart from the stand portion, including the straps 240 and 235, the hooks 220, and the buckle 30. FIG. 11 shows a close-up bottom view of the hook 220, which comprises a slot 225, to which a strap is affixed, and a non-slip surface 230, which both minimizes movement and protects the instrument's finish. FIG. 12 is a close-up side view of the hook 220. FIG. 14 shows the strap 25 attached to the buckle 30, apart from the back plate 15. FIG. 15 shows a strap assembly adapted for use with guitars without an upper cutaway. The upper endpin loop and strap 160 are shown separated from the buckle 30, which is affixed to the strap 165.

In one embodiment, to use the instrument stand 8 with a guitar 5 that has a top and bottom cutaway, one first rests the guitar 5 on any preferably soft surface face-down, and places the front portion of bottom plate 15 (see FIG. 6) on the back of the guitar 5 with the angled instrument rests 80 extending downward at the bottom of guitar 5 and on both sides of lower strap pin 170. One then loosely wraps strap 25 around lower cutaway 3 and upper cutaway 1, weaves the excess strapping through buckle 30, and tightens stand 8 to the back of guitar 5. (Once this configuration is woven, it may be maintained loosely on the bottom plate for future use, and not be required to be woven again unless the user desires to adjust the strap 25 for a different instrument). Then, lower strap pin retaining strap 95 is looped around lower strap pin 170. Then, strap 95, which is woven through slot 205, is pulled tightly and fastened, for example using hook and loop fastener 210, to create a secure connection between the angled instrument rests 80, the strap pin retaining strap, and the lower strap pin. A second tightening adjustment of strap 25 may be required to fully secure the stand 8 to the guitar 5. FIG. 1 shows the stand 8 mounted to the back of the guitar 5.

To use stand 8 on a single cutaway guitar 7 (see FIG. 2), the upper strap pin assembly 160 is looped around the upper strap pin 155 and woven through the buckle 30 which is attached to strap 165. The bottom of the stand can be attached to the lower strap pin in the same manner as described above.

Figure 18:
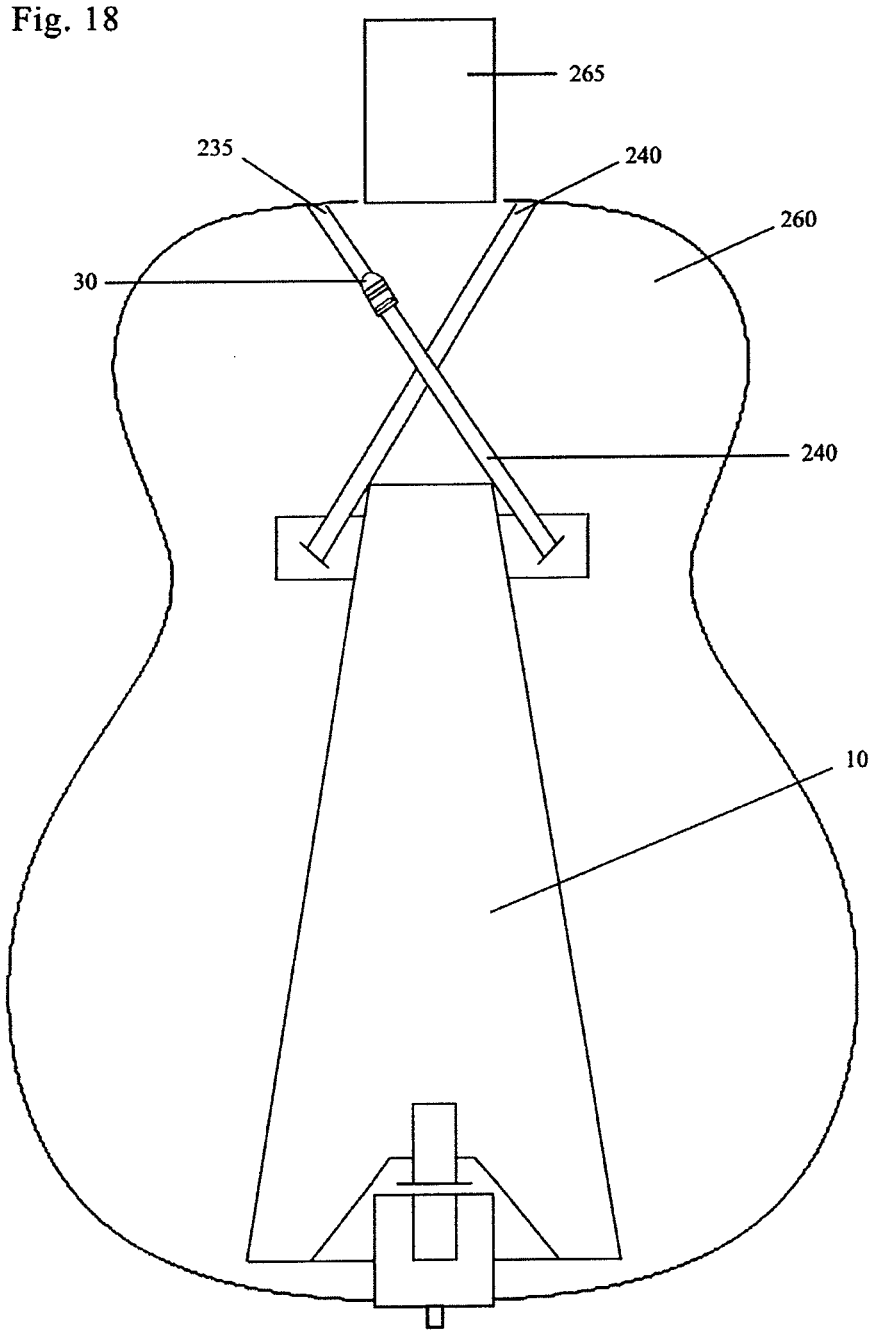
FIG. 18 is a plan view of an instrument stand according to an embodiment, shown in a closed position and mounted to the back of a guitar, with the strap assembly wrapping around the top of the guitar (near the neck) to grip the sound hole.

To use the stand on an acoustic guitar 260, the straps 235 and 240 are wrapped around the front of the acoustic guitar 260 and hooked onto the sound hole 250 with the hooks 220 as shown in FIG. 11 and FIG. 17. The straps are then tightened with the buckle 30 on the back of the acoustic guitar 260 as shown in FIG. 18. The bottom can be attached to the lower strap pin in the same manner as described above.

To deploy and use stand 8, one first grips the neck 6 of the guitar with one hand, and pulls on the pull strap 65 which causes the cross member 70 to push out the top plate 10 to its open position. When the cross member reaches the bottom of cavity 75, the pull strap is affixed to the top plate 10 using hook and loop fastener 135, thereby securing the cross member, top plate, and bottom plate in the open position and preventing movement or accidental collapse. The guitar may then be stood upright on at least three points of contact (e.g., the support pin 85 and the non-slip footings 130). To disengage and fold the stand 8, one grips the guitar neck 6 with one hand, releases the pull strap 65 from the top plate 10, and pushes on the cross member 70 causing it to slide back into cavity 75 as it folds together. Movement of the cross member 70 also pulls the pull strap 65 back into position against the keeper 190. Once the cross member is in the closed position, the pull strap is again affixed to the top plate 10 using the hook and loop fastener 135, now securing the top plate 10 to the bottom plate 15 in the folded position, thus preventing accidental opening of the stand while not in use.

Figure 19:
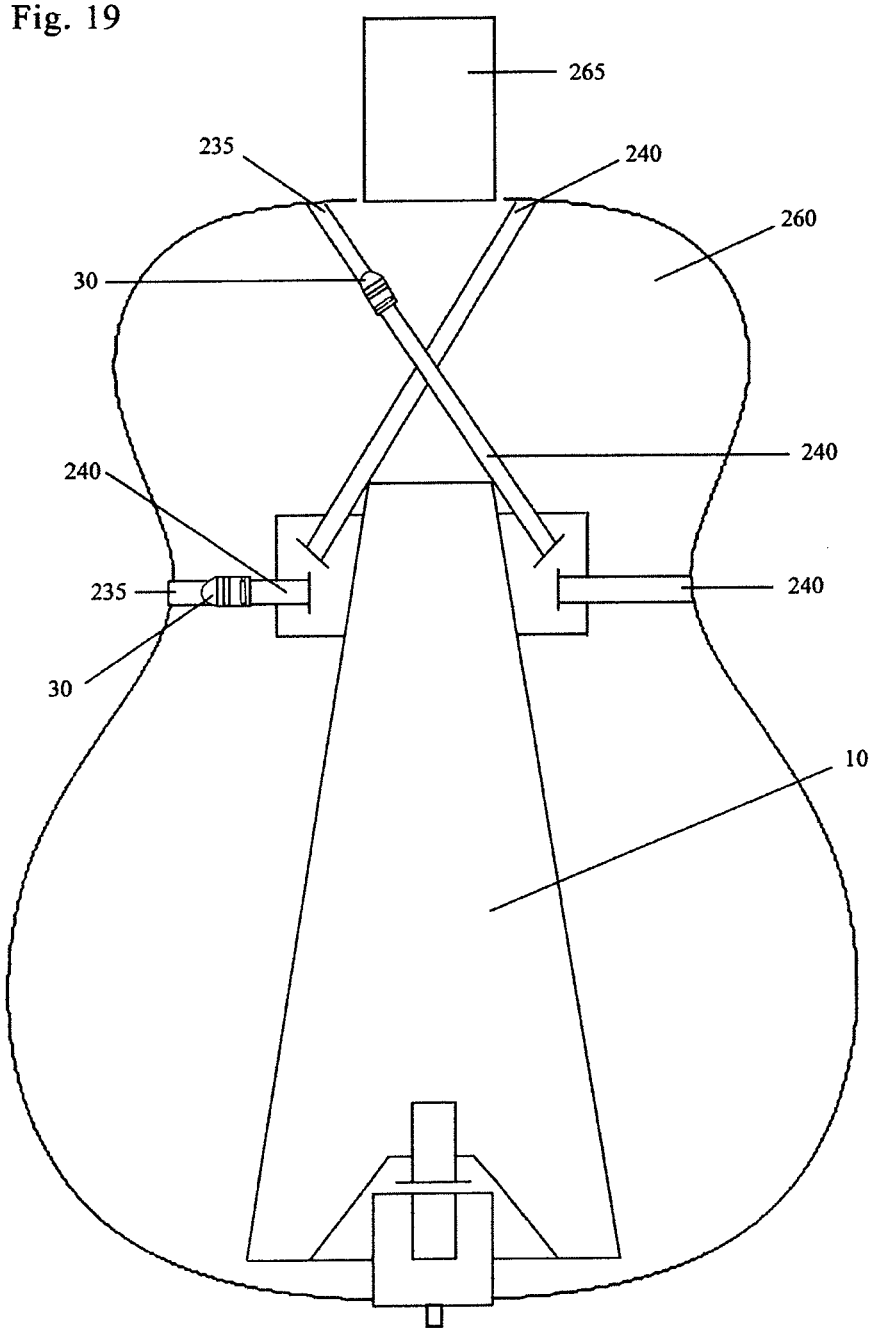
FIG. 19 is a plan view of an instrument stand according to an embodiment, shown in a closed position and mounted to the back of a guitar, with the strap assembly wrapping around the both the sides of the guitar and the top of the guitar (near the neck) to grip the sound hole.

FIG. 16 is a perspective drawing of an instrument stand according to another embodiment, shown in an open position and mounted to another exemplary acoustic guitar, with the strap assembly hooked onto the sound hole near the neck of the guitar. FIG. 17 is a plan view of an instrument stand according to an embodiment, shown in a closed position and mounted to the back of a guitar, with the strap assembly wrapping around the sides of the guitar to grip the sound hole. FIG. 18 is a plan view of an instrument stand according to an embodiment, shown in a closed position and mounted to the back of a guitar, with the strap assembly wrapping around the top of the guitar (near the neck) to grip the sound hole. Note that the strap may cross itself providing additional tension. FIG. 19 is a plan view of an instrument stand according to an embodiment, shown in a closed position and mounted to the back of a guitar, with the strap assembly wrapping around both the sides of the guitar and the top of the guitar (near the neck) to grip the sound hole.

Although illustrated within the context of a stand for supporting various types of guitars, the present invention may also be used with other instruments, including, for example and without limitation, cellos and violins, or any other object for which an easily deployed and portable stand may be desirable. It will be appreciated that each component of the instrument stand may have any shape compatible with its intended function and may be made of any materials compatible with its intended function. It will be understood by those of skill in the art that numerous and various modifications can be made without departing from the spirit of the present invention. Therefore, it should be clearly understood that the forms of the invention described herein are illustrative only and are not intended to limit the scope of the invention. In addition, as will be recognized, the present invention may be embodied within a form that does not provide all of the features and benefits set forth herein, as some features may be used or practiced separately from others.

What is claimed is:

1. An instrument stand for supporting a musical instrument, the instrument stand comprising:

a first plate member;

a second plate member pivotally coupled to the first plate member;

an instrument securing member adapted to secure the instrument stand to the musical instrument, wherein the instrument securing member is coupled to the first or second plate member, and the plate member to which the instrument securing member is coupled comprises a first pair of slots configured to receive the instrument securing member; and a cross member coupled at a first end to the first or second plate member, the cross member lying in a generally flat configuration with respect to the first and second plate members at least when the stand is in the closed position, and the cross member configured to maintain an angular separation of the first and second plate members at least when the stand is in the open position, wherein the plate member not coupled to the first end of the cross member comprises a groove for slidably receiving a second end of the cross member at least when the stand is moved between the closed position and the open position.

2. The instrument stand of claim 1, wherein the instrument securing member comprises a first flexible strap.

3. The instrument stand of claim 1, wherein the instrument securing member forms a loop.

4. The instrument stand of claim 1, wherein the instrument securing member has an adjustable length.

5. The instrument stand of claim 1, wherein the instrument securing member is removably coupled to the first or second plate member.

6. The instrument stand of claim 1, wherein the first pair of slots extend generally parallel to one another.

7. The instrument stand of claim 1, wherein the plate member to which the instrument securing member is coupled comprises a second pair of slots configured to receive the instrument securing member.

8. The instrument stand of claim 7, wherein the second pair of slots extend at an angle with respect to one another and with respect to the first pair of slots.

9. The instrument stand of claim 1, further comprising a support member coupled to the first or second plate member and configured to cooperate with the plate member to which it is coupled to support the musical instrument, at least when the stand is in an open position.

10. The instrument stand of claim 9, wherein the support member extends in a generally normal direction from the plate member to which it is coupled.

11. The instrument stand of claim 1, further comprising a securement member configured to releasably secure the first plate member and the second plate member together at least when the stand is in a closed position.

12. The instrument stand of claim 11, wherein the first plate member and the second plate member are secured in a generally flat configuration at least when the stand is in a closed position.

13. The instrument stand of claim 11, wherein the securement member comprises a hook and loop fastener.

14. The instrument stand of claim 11, wherein the securement member comprises a second flexible strap.

15. The instrument stand of claim 14, wherein the second flexible strap is coupled to the cross member.

16. The instrument stand of claim 1, wherein the cross member is coupled to the first plate member.

17. The instrument stand of claim 1, wherein the musical instrument is selected from the group consisting of a guitar, a bass guitar, an acoustic guitar, a lute, a sitar, a mandolin, a banjo, a ukulele, a violin, a viola, a cello, an upright bass, a guitar shaped video-game controller, a keyboard, and a synthesizer.

* * * * *

UNITED STATES PATENT AND TRADEMARK OFFICE

CERTIFICATE OF CORRECTION

PATENT NO. : 8,637,752 B2
APPLICATION NO. : 13/060266
DATED : January 28, 2014
INVENTOR(S) : Paul Innocenti It is certified that error appears in the above-identified patent and that said Letters Patent is hereby corrected as shown below:

On the Title Page (Item 60) Related U.S. Application at line 1-2, change "Nov. 21, 2008." to --Nov. 06, 2008.--.

In the Specification

In column 1 at line 8, Change "Nov. 21, 2008," to --Nov. 06, 2008,--.

In column 5 at line 14, Change "undo" to --undue--.

Signed and Sealed this
Twelfth Day of August, 2014

Michelle K. Lee

Michelle K. Lee
*Deputy Director of the United States Patent and Trademark Office*